United States Patent [19]

Torniainen

[11] 4,425,696

[45] Jan. 17, 1984

[54] METHOD OF MANUFACTURING A HIGH PERFORMANCE HEAT TRANSFER TUBE

[75] Inventor: Matti J. Torniainen, Chittenango, N.Y.

[73] Assignee: Carrier Corporation, Syracuse, N.Y.

[21] Appl. No.: 280,025

[22] Filed: Jul. 2, 1981

[51] Int. Cl.[3] ..... B23P 15/26

[52] U.S. Cl. ..... 29/157.3 AH; 29/727; 72/98; 72/370; 72/78

[58] Field of Search ..... 29/727, 157.3 AH, 157.4; 72/68, 78, 98, 370

[56] References Cited

U.S. PATENT DOCUMENTS

| | | | |
|---|---|---|---|
| 2,586,011 | 2/1952 | Doelter | 29/157.3 AH |
| 3,454,081 | 7/1969 | Kun et al. . | |
| 3,457,990 | 7/1969 | Theophilos et al. . | |
| 3,496,752 | 2/1970 | Kun et al. . | |
| 3,559,437 | 2/1971 | Withers, Jr. | 29/157.3 AH |
| 3,566,514 | 3/1971 | Szumigala . | |
| 3,683,656 | 8/1972 | Lewis | 29/157.3 AH |
| 3,684,007 | 8/1972 | Ragi . | |
| 3,696,861 | 10/1972 | Webb . | |
| 3,768,290 | 10/1973 | Zatell . | |
| 3,768,291 | 10/1973 | Rieger . | |
| 3,847,212 | 11/1974 | Withers, Jr. et al. | 29/157.3 AH |
| 3,881,342 | 5/1975 | Thorne . | |
| 4,059,147 | 11/1977 | Thorne . | |
| 4,060,125 | 11/1977 | Fujie et al. . | |
| 4,168,618 | 9/1979 | Saier et al. | 72/98 |
| 4,179,911 | 12/1979 | Saier et al. | 72/98 |
| 4,313,248 | 2/1982 | Fujikake | 72/98 |

OTHER PUBLICATIONS

Article by S. G. Bankoff "Entrapment of Gas in the Spreading of Liquid over a Rough Surface".

Article by Peter Griffith and John D. Wallis "The Role of Surface Conditions in Nucleate Boiling".

*Primary Examiner*—Howard N. Goldberg

*Assistant Examiner*—V. K. Rising

*Attorney, Agent, or Firm*—David L. Adour

[57] ABSTRACT

A method of making a new high performance heat transfer tube for use in an evaporator of a refrigeration system is disclosed. According to this novel method, a grooved mandrel is placed inside an unformed tube and a tool arbor having a tool gang thereon is rolled over the external surface of the tube. The unformed tube is pressed against the mandrel to form at least one internal rib on the interior of the tube. Simultaneously, at least one external fin convolution is formed on the exterior of the tube. The external fin convolution has depressed sections above the internal rib where the tube is forced into the grooves of the mandrel to form the rib. A smooth roller-like disc on the tool arbor is rolled over the external surface of the tube after the initial formation of the external fin and internal rib. The resulting heat transfer tube has an exterior with a subsurface channel consisting of interconnected cavities and subsurface passages. The interior of the tube has a helically extending rib located beneath the openings of the external cavities.

4 Claims, 4 Drawing Figures

METHOD OF MANUFACTURING A HIGH PERFORMANCE HEAT TRANSFER TUBE

BACKGROUND OF THE INVENTION

The present invention relates to heat exchangers, and more particularly to heat exchangers having tubes for transferring heat between a fluid flowing through the tubes and another fluid in contact with the exterior of the tubing. Specifically, the present invention relates to a method of making heat transfer tubing for use in a heat exchanger of the type wherein a fluid to be cooled is passed through the tubing and a boiling liquid is in contact with the exterior of the tubing whereby heat is transferred from the fluid in the tubing to the boiling liquid.

In an evaporator of certain refrigeration systems a fluid to be cooled is passed through heat transfer tubing while refrigerant in contact with the exterior of the tubing changes state from a liquid to a vapor absorbing heat from the fluid within the tubing. The external and internal configuration of the tubing is important in determining the overall heat transfer characteristics of the tubing. For example, it is known that the presence of vapor entrapment sites on the external surface of a tube enhance the transfer of heat from the fluid within the tube to the boiling refrigerant surrounding the tube. It is theorized that the provision of vapor entrapment sites creates sites for nucleate boiling. According to this theory the trapped vapor at or slightly above the saturation temperature increases in volume as heat is added until surface tension is overcome and a vapor bubble breaks free from the heat transfer surface. As the vapor bubble leaves the heat transfer surface, liquid refrigerant enters the vacated volume trapping the remaining vapor and another vapor bubble is formed. The continual bubble formation together with the convection effect of the bubbles traveling through and mixing the liquid refrigerant results in improved heat transfer.

A nucleation site is most stable when it is of the re-entrant type. See, for example, Griffith, P. and Wallis, J. D., "The Role of Surface Conditions in Nucleate Boiling", Chemical Engineering Progress Symposium Series, No. 30, Volume 56, pages 49 through 63, 1960. In this context a re-entrant nucleation site is defined as a cavity in which the size of the surface opening is smaller than the subsurface cavity. U.S. Pat. Nos. 3,696,861 and 3,768,290 disclose heat transfer tubes having such re-entrant type cavities.

Also, it is known that an excessive influx of ambient liquid can flood or deactivate a nucleation site. See, for example, Bankoff, S. G., "Entrapment of Gas in the Spreading of a Liquid Over a Rough Surface", A. I. Ch. E. Journal, Volume 4, pages 24 through 26, March, 1958. In this regard, it is known that a heat transfer surface having "minute tunnels" communicating with the surroundings through openings having a specified "opening ratio" may provide good heat transfer. See, for example, U.S. Pat. No. 4,060,125 to Fujie, et al.

In regard to the interior surface configuration of a heat transfer tube it is known that providing an internal ridge on the tube may enhance the heat transfer characteristics of the tube due to the increased turbulence of the fluid flowing through the ridged tube. See, for example, U.S. Pat. Nos. 4,059,147 and 3,881,342. These patents relate to heat transfer tubes having exterior re-entrant type nucleation cavities and having interior ridges.

As disclosed in U.S. Pat. Nos. 4,059,147 and 3,881,342, a heat transfer tube may be formed by rolling a tool arbor, having discs attached thereto, over the external surface of the unformed tube to form fins on the exterior of the tube, while, at the same time, pressing the tube against a grooved mandrel to form interior ridges on the tube. The external fins are bent over to form cavities by drawing the tube through a die after the fins are formed. All the cavities have continuous openings to allow fluid communication with the surroundings of the tube and the configuration of the cavities is critical in achieving optimal heat transfer characteristics with such a tube.

A heat exchanger, such as an evaporator of a refrigeration system, utilizing high performance heat exchange tubing, such as tubing having the features described previously, has increased capacity over that capacity obtained when the heat exchanger is constructed using other types of tubing, such as conventional straight-finned tubing. However, a heat exchanger constructed with high performance tubing is cost-effective only if any increase in the cost of manufacturing the high performance tubing is offset by the improved capacity and/or the reduced size of the heat exchanger. Therefore, heat transfer tubing having performance advantages, such as exterior re-entrant nucleation cavities and interior ridges, without performance disadvantages, such as "flooding" exterior nucleation cavities, is desirable from the viewpoint of better performance resulting in improved cost-effectiveness. Also, the more efficiently such a high performance heat transfer tube is constructed the more cost-effective is the tube.

SUMMARY OF THE INVENTION

Therefore, an object of the present invention is to provide an efficient method of making a heat transfer tube having superior heat transfer characteristics.

Another object of the present invention is to provide an efficient method of making a high performance heat transfer tube for use in an evaporator of a refrigeration system of the type described above whereby a cost-effective evaporator can be constructed using this tubing.

These and other objects of the present invention are attained by a novel method of making a new heat transfer tube having at least one internal rib and at least one helically extending external fin convolution. After rolling, the external fin has a base portion which is substantially perpendicular to the tube wall and has a tip portion which is inclined toward the adjacent convolution. The sections of the external fin convolution which are located above an internal rib comprise cavities with openings to the surroundings of the tube. The sections of the external fin convolution which are not above an internal rib are closed to form subsurface passages which communicate with the surroundings of the tube through the cavities and the cavity openings of those sections of the fin convolution which are located above an internal rib. This new heat transfer tube is the subject of a commonly assigned, concurrently filed United States patent application entitled "High Performance Heat Transfer Tube", having Ser. No. 279,901, which was filed on July 2, 1981 in the name of James P. Shawcross, Matti J. Toriainen, and Achint Mathur.

The new heat transfer tube is manufactured in a cost-effective manner by a single pass process with a tube finning machine. According to this novel method, a grooved mandrel is placed inside an unformed tube and a tool arbor having a tool gang thereon is rolled over the external surface of the tube. The unformed tube is pressed against the mandrel to form at least one internal rib on the internal surface of the tube. Simultaneously, at least one external fin convolution is formed on the external surface of the tube by the tool arbor with the tool gang. The external fin convolution has depressed sections above the internal rib where the tube is forced into the grooves of the mandrel to form the rib. A smooth roller-like disc on the tool arbor is rolled over the external surface of the tube after the external fin is formed. The smooth roller-like disc is designed to bend over the tip portion of the external fin to touch the adjacent fin convolution to form subsurface passages only at those sections of the external fin which are not located above an internal rib. The tip portion of the depressed sections of the external fin, which are located above an internal rib, are bent over but do not touch the adjacent convolution thereby leaving cavity openings which provide fluid communication between the surroundings of the tube and the cavities and the subsurface passages.

BRIEF DESCRIPTION OF THE DRAWINGS

The present invention, together with the objects and advantages thereof, may be understood best by reference to the following description in conjunction with the accompanying drawings, in which like reference numerals identify like elements, and in which.

DESCRIPTION OF THE PREFERRED EMBODIMENTS

The embodiment of the present invention described below is especially designed for use in an evaporator of a refrigeration system having a fluid to be cooled passing through heat transfer tubes and having refrigerant which is vaporized in contact with the external surfaces of the tubes. Typically, a plurality of heat transfer tubes are mounted in parallel and connected so that several tubes form a fluid flow circuit and a plurality of such parallel circuits are provided to form a tube handle. Usually, all the tubes of the various circuits are contained within a single casing wherein they are immersed in the refrigerant. The heat transfer capabilities of the evaporator are largely determined by the heat transfer characteristics of the individual heat transfer tubes.

Figure 1:
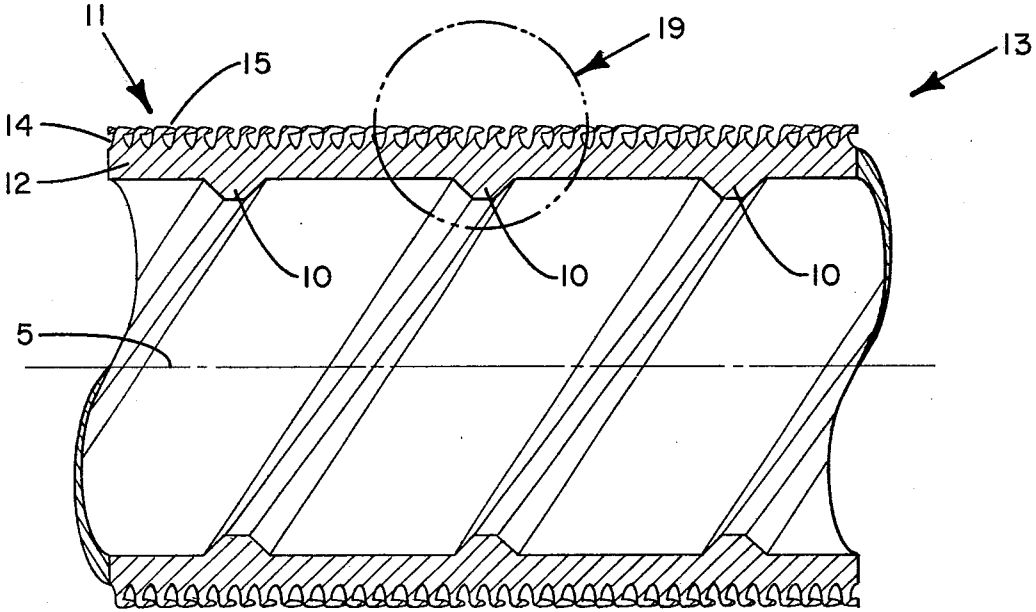
FIG. 1 shows a partial longitudinal section of a heat transfer tube constructed according to the principles of the present invention.
Figure 2:
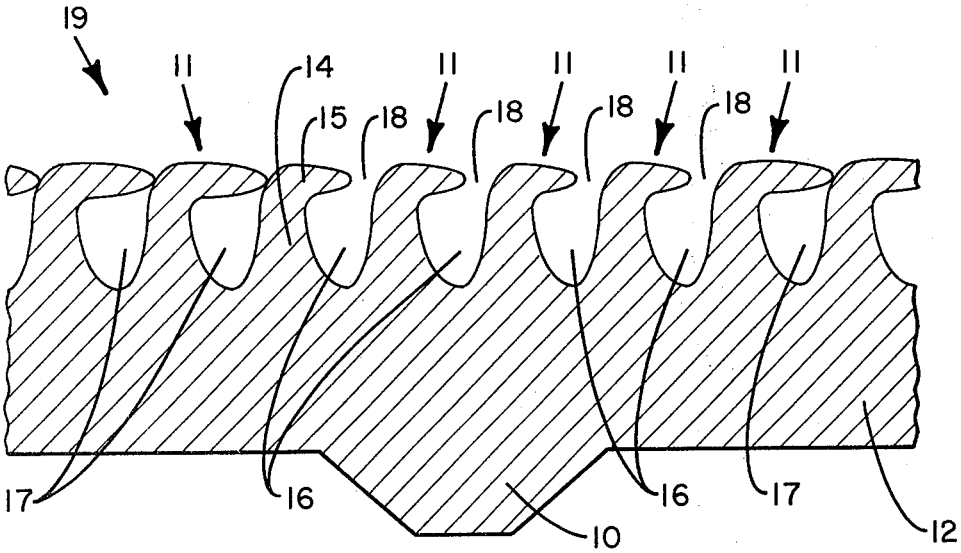
FIG. 2 shows an enlargement of a portion of the section of the heat transfer tube shown in FIG. 1.

Referring now to the drawings, FIG. 1 is a longitudinal cross-sectional view of a cylindrical heat transfer tube 13, constructed according to the principles of the present invention, for use in an evaporator of a refrigeration system. FIG. 2 is an enlargement of a portion 19 of the heat transfer tube 3 shown in FIG. 1 which shows more details of the exterior construction of the tube 13. As shown in FIG. 1, the cylindrical tube 13 has a plurality of internal ribs 10 and one external fin convolution 11 on its tube wall 12. The internal ribs 10 helically extend around the interior of the tube 13 and the external fin convolution 11 helically extends around the exterior of the tube 13. The internal ribs 10 and external fin convolution 11 are integral parts of the tube wall 12.

The internal ribs 10, as shown in FIGS. 1 and 2, are trapezoidal in cross-section, as shown in FIGS. 1 and 2, but their exact shape is not critical. The purpose of the internal ribs 10 is to create turbulence in the fluid flowing through the heat transfer tube 13. As is known in the heat transfer art, turbulent flow within the tube 13 is an important factor in determining heat transfer between the fluid in the tube 13 and the tube wall 12. Also, the internal ribs 10 increase the surface area per unit length available for heat transfer.

As shown in FIGS. 1 and 2, the external fin convolution 11 comprises a base portion 14 and a tip portion 15. The base portion 14 extends generally radially outward from the tube wall 12. The tip portion 15 is bent over towards the adjacent convolution 11 to form a continuous subsurface channel consisting of cavities 16 and subsurface passages 17. This continuous subsurface channel helically extends around the exterior of the tube 13. The cross-sectional configuration of the channel is substantially uniform along the longitudinal axis 5 of the tube 13. The tip portion 15 touches the adjacent convolution 11 at those locations not above an internal rib 10 to form subsurface passages 17. The subsurface channel communicates with the surroundings of the tube through the openings 18 of the cavities 16 located above the internal ribs 10. The uniform cross-section of the channel and substantially smooth walls of this channel aid in preventing the buildup of contaminents, such as oil and/or foreign particles, in the subsurface passages 17 and cavities 16 after prolonged use of the heat transfer tube 13.

Although FIGS. 1 and 2 show a tube 13 with a single helical channel on the exterior of the tube 13 the use of a single channel is not required. The number of channels which are utilized is a design choice largely determined by the tooling used to form the exterior of the tube 13. For example, multiple channels may be formed on the exterior of the tube 13 by using multiple lead, fin forming tooling with a tube finning machine. Also, multiple channels may be formed on the same tube 13 by using single lead tooling and discontinuing the channel at some location over the length of the tube 13 and restarting a new channel at another location.

Also, FIGS. 1 and 2 show a tube 13 having openings 18, for the cavities 16, only at those locations above an internal rib 10. The openings 18 need not be positioned relative to the internal ribs 10 in this arrangement to achieve high performance heat transfer characteristics. This particular arrangement is shown since a tube 13 can be efficiently constructed with this configuration by the novel tube forming method which is described below.

The cavities 16 are of the re-entrant type for nucleate boiling. The openings 18 provide a place for the fluid surrounding the heat transfer tube to enter and leave the re-entrant cavities 16. Between the openings 18 the surface of the tube is rolled closed, creating subsurface passages 17 between cavities 16, thus forming discrete re-entrant boiling cavities 16 which prevent an influx of ambient fluid that could "flood" or deactivate the nucleation sites. These subsurface passages 17 also provide for communication of liquid and vapor between cavities 16. The boiling fluid enters and leaves the tubing surface through the re-entrant cavity openings 18, allowing the subsurface channels to fill with a two phase mixture. The subsurface passages 17 preheat and vaporize the thin liquid films which adhere to the passage walls. The active nucleation occurs at the cavity openings 18.

In operation, liquid refrigerant will enter a subsurface channel from an opening 18 which is closest to the bottom part of the tube 13 relative to its position in a tube bundle of an evaporator. This liquid refrigerant is saturated or slightly subcooled as it enters the lower cavity opening 18. However, the fluid is heated in the subsurface channel and rises up through the channel to a cavity opening 18 positioned nearer the top of the tube 13. The fluid is heated and vaporized as it travels through the subsurface channel to the cavities 16 where active nucleation occurs. Vapor bubbles then leave the cavities 16 through the openings 18. The overall effect is to provide a tube 13 with high performance heat transfer characteristics.

The continuous subsurface channel consisting of cavities 16 and subsurface passages 17 creates a pattern of open sections, corresponding to the surface area of the tube 13 having the cavity openings 18, and closed sections, corresponding to the surface area of the tube 13 having the subsurface passages 17, on the exterior of the tube 13. For the tube shown in FIGS. 1 and 2 the open sections are located approximately above the internal ribs 10. Thus, the open sections form a helical pattern of openings on the exterior of the tube 13 corresponding to the helical pattern of the internal ribs 10. The size of the open sections varies depending on the dimensions of the external fin convolution 11 and the internal ribs 10. A typical open section is between 0.001 and 0.007 inches in width and approximately 0.040 inches in length. This open section size is for a tube with an inside diameter on the order of 0.6 inch and having a tube wall thickness on the order of 0.028 inch, and having fifty-three external fin turns per inch. A typical tube interior has an internal rib pattern of 18 starts with an internal rib height of approximately 0.013 inches and a 30° helix angle for each rib. Such a tube has a ratio of open area to total outside surface area of approximately six percent. These characteristics are only one set of parameters for constructing a heat transfer tube according to the principles of the present invention. The general principles taught by the present invention are applicable to a wide range of external fin and internal rib configurations and tube sizes.

Figure 3:
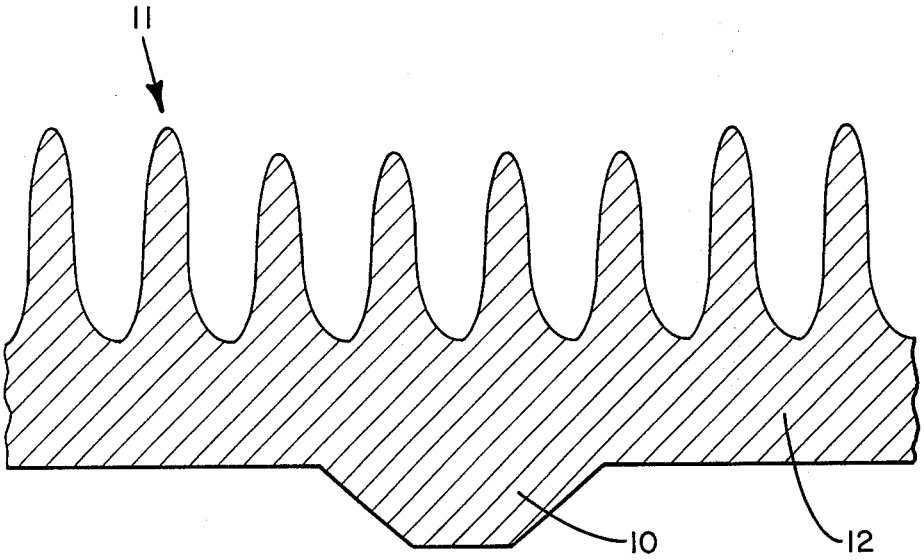
FIG. 3 shows the portion of the heat transfer tube shown in FIG. 2 before the external fin convolution 11 has been rolled over, as described in conjunction with FIG. 4, to form the continuous subsurface channel with cavities 16 and closed subsurface passages 17 as shown in FIGS. 1 and 2.
Figure 4:
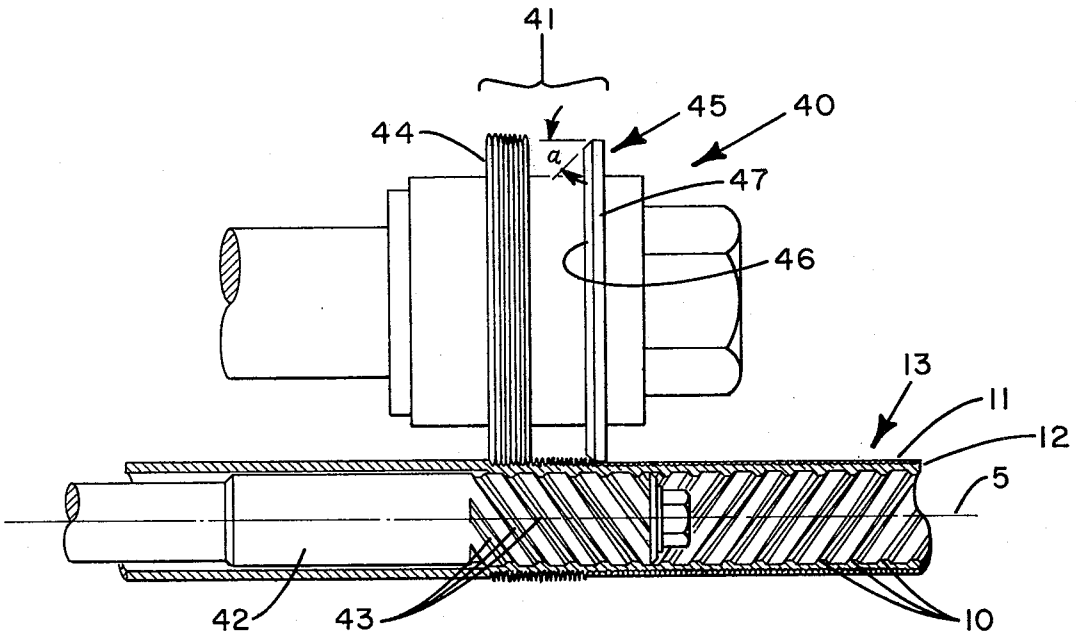
FIG. 4 is a view of a tube, a grooved mandrel, and a tool arbor having a tool gang thereon for rolling the tube on the grooved mandrel to form the heat transfer tube shown in FIGS. 1, 2 and 3.

One major advantage of the heat transfer tube 13 shown in FIGS. 1 and 2 is the ease with which it can be manufactured. As shown in FIG. 4, a tool arbor 40 with a tool gang 41 is used with a mandrel 42 to simultaneously form the external fin convolution 11 and internal ribs 10 on the tube 13 with a tube finning maching (not shown). The mandrel 42 has grooves 43 corresponding to the internal rib pattern which is to be formed on the interior of the tube 13. The tool gang 41 comprises a plurality of discs 44 which are used to displace the material of the tube wall 12 of the tube 13 to form the external fin convolution 11. A smooth roller-like disc 45 is the last disc to contact the tube 13. The disc 45 rolls over the tip portion 15 of the fin convolution 11 toward the adjacent convolution to form the subsurface passages 17, cavities 16, and openings 18, as shown in FIGS. 1 and 2. As discussed previously, the tube 13 with subsurface passages 17, openings 18, and internal ribs 10 is primarily suited for use in an evaporator of a refrigeration system. However, it should be noted that a straight-finned tube may be formed by eliminating the smooth disc 45 from the tool gang 41 thereby not rolling over the tip portion 15 of the fin convolution 11. Such a straight-finned tube provides heat transfer characteristics which make it especially suitable for use in a condenser and an enlarged portion of a section of such a tube is illustrated in FIG. 3.

In operation, the unformed tube 13 is placed over the mandrel 42. The mandrel 42 is of sufficient length that the interior surface of the tube 13 is supported beneath the discs 44 on the tool arbor 40. The discs 44 on the tool arbor 40 are brought into contact with the tube 13 at a small angle relative to the longitudinal axis 5 of the tube 13. This small amount of skew provides for tube 13 being driven along its longitudinal axis as arbor 40 is rotated. The discs 44 displace the material of the tube wall 12 to form the external fin convolution 11 while at the same time depressing the tube 13 against the mandrel 42 to displace the tube wall 12 of the tube 13 into the grooves 43 of the mandrel 42 to form the internal ribs 10. FIG. 2 illustrates the configuration of the tube wall 12 of the tube 13 after the discs 44 are rolled over the exterior of the tube 13 but before the smooth disc 45 is rolled over the tube 13.

The displacement of the tube wall 12 to form the internal ribs 10 results in forming depressed sections of the external fin convolution 11 overlying the internal ribs 10. When the smooth roller-like disc 45 is rolled over the external surface of the tube 13, after the finning discs 44 have formed the external fin convolution 11, it bends over the tip portion 15 of the fin convolution 11 to touch the adjacent convolution only at those sections of the fin convolution 11 which are not located above an internal rib 10 and therefore, which are not depressed. This results in the formation of the subsurface passages 17. The sections of the external fin convolution 11 which are depressed are rolled over but do not touch the adjacent convolution thereby forming the cavity openings 18.

The structure of the smooth roller-like disc 45 is an important factor with respect to the ease with which the fin convolution 11 may be rolled over to form the tip portion 15 of the convolution 11. This structure is important because sections of the fin convolution 11 may not be exactly vertical, relative to the tube wall 12, when the fin convolution 11 is formed by the finning discs 44 before the disc 45 contacts the convolution 11. If the fin convolution 11 is leaning toward the disc 45 prior to contact with the disc 45, the convolution 11 may be rolled in the wrong direction by the disc 45. If the fin convolution 11 is exactly vertical and the disc 45 has a flat edge then the convolution 11 may be flattened rather than rolled over by contact with the disc 45.

One way of insuring that the fin convolution 11 is properly rolled over by the disc 45 is to place aligning discs on the tool arbor 40 behind the finning discs 44 to properly orient the convolution 11 prior to contact with the disc 45. Alternatively, as shown in FIG. 4, the smooth roller-like disc 45 may comprise a portion 46 with an angled rolling surface and a main body portion 47 with a cylindrical rolling surface. As shown in FIG. 4, the rolling surface of the portion 46 is oriented at an angle, $\alpha$, to the rolling surface of the main body portion 47. It may be desirable to structure the disc 45 in this manner even if aligning discs are placed on the tool arbor 40 to further insure that the convolution 11 is properly rolled over by the disc 45.

The portion 46 of the disc 45 is designed to initiate bending of the fin convolution 11 in the proper direction by contacting the convolution 11 at an angle before the main body portion 47 of the disc 45 completely rolls over the convolution 11 to form the tip portion 15. The optimcal angle, $\alpha$, of the surface of the portion 46 relative to the surface of the main body portion 47 depends on factors such as the amount of vertical deviation of the fin convolution 11 prior to contacting the disc 45, the hardness of the material from which the fin convolution 11 is made, and the overall dimensions and configuration of the fin convolution 11 and the tooling. An angle, $\alpha$, of 18° has been found to provide especially good results when making a fifty-three external fins turns per inch tube with the specific dimensions described previously. However, other angles, $\alpha$, including zero, may be acceptable depending on what results are desired with respect to the overall configuration of the tube 13. The diameter of the main body portion 47 of the disc 45 determines the size of the cavity openings 18 since, for example, a larger diameter body portion 47 results in rolling over more of the fin convolution 11 toward the adjacent convolution thereby reducing the size of the openings 18.

After rolling with a single lead tooling, a fin convolution 11 forms a single helical channel on the exterior of a tube 13. If double lead tooling is used two separate channels will be formed. More channels may be provided by increasing the number of leads in the tooling or by discontinuing the fin convolution 11 at some location over the length of the tube 13 and beginning a new fin convolution 11. The configuration of the internal ribs 10 can be adjusted in a similar manner by changing the construction of the mandrel 42.

The tube 13 with its exterior and interior configuration is formed in a single pass process on the finning machine. This is an efficient and economical way of constructing a high performance heat transfer tube. This process eliminates the step of drawing the tube 13 through a die and other such steps for bending over the fin convolution 11. It should be noted that simply drawing the tube 13 through a die after the straight-fin convolution 11 is formed by the discs 44 does not provide for forming the subsurface passages 17 on the exterior of the tube 13. This is because the conventional materials from which the tube 13 is made, such as copper, are resilient and would spring back after being drawn through the die.

The foregoing is only one heat transfer tube which may be constructed by a method according to the principles of the present invention. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A method of making an internally ribbed and externally finned heat transfer tube from an unformed tube which comprises the steps of:

positioning the unformed tube on a mandrel, said mandrel having at least one helically extending depression on its surface;

displacing the tube wall of the unformed tube by rolling discs over the exterior surface of the tube above the mandrel to press the tube against the mandrel to form at least one helically extending rib on the interior surface of the tubing and to form simultaneously at least one helically extending fin convolution extending around the exterior of the tubing, said external fin convolution having depressed sections located above the internal rib; and rolling a smooth roller-like disc over the exterior surface of the tube after the external fin convolution and internal rib are formed to bend over the tip portion of the external fin convolution to touch the adjacent convolution at the non-depressed sections of the fin convolution to form subsurface passages which communicate with the surroundings of the tube through openings located at the depressed sections of the fin convolution which are not bent over enough by the smooth disc to touch the adjacent convolution.

2. The method of claim 1 wherein the step of displacing the unformed tube wall comprises applying rolling pressure to the exterior of the tube with a plurality of aligned finning discs positioned at an angle to the longitudinal axis of the tube to produce several multiple-start helically extending fin convolutions around the exterior of the tubing, said external fin convolutions having depressed sections, located above the internal rib(s), where the unformed tube is pressed into the depression(s) on the mandrel as the external fin convolutions are formed by the rolling pressure of the finning discs.

3. A tool for making an internally ribbed and externally finned heat transfer tube from an unformed tube, comprising:

a mandrel with at least one helical groove, said mandrel designed to be placed inside the unformed tube;

a tool arbor;

at least one finning disc attached to the tool arbor for displacing the tube wall of the unformed tube to form simultaneously at least one helically extending straight fin convolution on the exterior of the tube and at least one rib on the exterior of the tube when said finning disc(s) is pressed against and rolled over the exterior of the unformed tube with the grooved mandrel placed inside the tube whereby the straight fin convolution has depressed sections where the tube wall is pressed into the groove(s) on the mandrel to form the rib(s); and a smooth-roller like disc attached to and positioned on the tool arbor to roll over the straight fin convolution formed by the finning disc(s) to form at least one continuous subsurface channel, said channel(s) having cavities located above the internal rib(s) and having closed subsurface passages located at the non-depressed sections of the fin convolution not above an internal rib.

4. The tool as recited in claim 3 wherein the smooth roller-like disc comprises:

a portion with an angled rolling surface for initially contacting the straight fin convolution(s), after the convolution is formed by the finning discs, to initiate bending of the convolution in a desired direction; and a main body portion with a cylindrical rolling surface connected to the angled rolling surface portion for rolling over the straight fin convolution after the convolution is initially bent by the angled surface portion.

* * * * *